US007458657B2

(12) United States Patent
Grose et al.

(10) Patent No.: US 7,458,657 B2
(45) Date of Patent: Dec. 2, 2008

(54) SINGLE-PASS INKJET PRINTING

(75) Inventors: David R. Grose, Hanover, NH (US); Nathan Hine, S.Strafford, VT (US); Paul Hoisington, Norwich, VT (US); Peter N. Wallis, Norwich, VT (US); Yong Zhou, Hanover, NH (US)

(73) Assignee: FUJIFILM Dimatix, Inc., Lebanon, NH (US)

( * ) Notice: Subject to any disclaimer, the term of this patent is extended or adjusted under 35 U.S.C. 154(b) by 109 days.

(21) Appl. No.: 11/566,371

(22) Filed: Dec. 4, 2006

(65) Prior Publication Data

US 2007/0091142 A1 Apr. 26, 2007

Related U.S. Application Data

(63) Continuation of application No. 11/114,935, filed on Apr. 26, 2005, now Pat. No. 7,156,502, which is a continuation of application No. 10/039,074, filed on Dec. 31, 2001, now Pat. No. 6,926,384, which is a continuation of application No. 09/277,839, filed on Mar. 26, 1999, now Pat. No. 6,575,558.

(51) Int. Cl.
*B41J 2/15* (2006.01)

(52) U.S. Cl. ..... 347/41; 347/12

(58) Field of Classification Search ..... 347/12, 347/15, 40, 31, 43

See application file for complete search history.

(56) References Cited

U.S. PATENT DOCUMENTS

| | | | |
|---|---|---|---|
| 4,254,409 | A | 3/1981 | Busby |
| 4,272,771 | A | 6/1981 | Furukawa |
| 4,463,359 | A | 7/1984 | Ayata et al. |
| 4,520,373 | A | 5/1985 | Ayata et al. |
| 4,534,814 | A | 8/1985 | Volpe et al. |
| 4,601,777 | A | 7/1986 | Hawkins et al. |
| 4,612,554 | A | 9/1986 | Poleshuk |
| 4,638,328 | A | 1/1987 | Drake et al. |
| 4,774,530 | A | 9/1988 | Hawkins |
| 4,786,357 | A | 11/1988 | Campanelli et al. |
| 4,829,324 | A | 5/1989 | Drake et al. |
| 4,863,560 | A | 9/1989 | Hawkins |
| 4,899,181 | A | 2/1990 | Hawkins et al. |
| 4,935,750 | A | 6/1990 | Hawkins |
| 5,057,854 | A | 10/1991 | Pond et al. |

(Continued)

FOREIGN PATENT DOCUMENTS

| | | |
|---|---|---|
| DE | 40 20 129 | 1/1992 |

(Continued)

OTHER PUBLICATIONS

Abstract, Eriksen, "Interlaced Scan Colour Ink-Jet Printer—Uses Multiple Spaced Apart Arrays of Print Nozzles, Each Array Ejecting Different Colour Ink", US Appln. 189,336, filed Jan. 31, 1994.

(Continued)

*Primary Examiner*—Lamson D Nguyen
(74) *Attorney, Agent, or Firm*—Fish & Richardson P.C.

(57) ABSTRACT

A single-pass print head has multiple orifice plates each serving some but not all of the area to be printed.

7 Claims, 12 Drawing Sheets

U.S. PATENT DOCUMENTS

| | | | | | |
|---|---|---|---|---|---|
| 5,059,984 | A | | 10/1991 | Moore et al. | |
| 5,079,563 | A | | 1/1992 | Starkweather et al. | |
| 5,103,101 | A | | 4/1992 | Berglund et al. | |
| 5,113,202 | A | | 5/1992 | Loce et al. | |
| 5,218,754 | A | | 6/1993 | Rangappan | |
| 5,239,312 | A | | 8/1993 | Merna et al. | |
| 5,257,043 | A | | 10/1993 | Kneezel | |
| 5,359,355 | A | | 10/1994 | Nagoshi et al. | |
| 5,367,324 | A | * | 11/1994 | Abe et al. | 347/43 |
| 5,469,199 | A | | 11/1995 | Allen et al. | |
| 5,625,389 | A | | 4/1997 | Eriksen et al. | |
| 5,633,663 | A | | 5/1997 | Matsubara et al. | |
| 5,696,544 | A | | 12/1997 | Komuro | |
| 5,724,086 | A | | 3/1998 | Mackin et al. | |
| 5,734,394 | A | | 3/1998 | Hackleman | |
| 5,771,052 | A | | 6/1998 | Hine et al. | |
| 5,793,392 | A | | 8/1998 | Tschida | |
| 5,808,655 | A | | 9/1998 | Haas et al. | |
| 5,880,756 | A | * | 3/1999 | Ishii et al. | 347/40 |
| 6,027,203 | A | | 2/2000 | Campbell | |
| 6,575,558 | B1 | | 6/2003 | Grose et al. | |
| 6,592,204 | B1 | | 7/2003 | Beliveau et al. | |
| 6,637,860 | B1 | | 10/2003 | Madeley | |

FOREIGN PATENT DOCUMENTS

| | | | |
|---|---|---|---|
| EP | 0 339 926 | B1 | 11/1989 |
| EP | 0 422 925 | A2 | 4/1991 |
| EP | 0 277 703 | B1 | 6/1991 |
| EP | 0 476 860 | A2 | 3/1992 |
| EP | 0564742 | | 12/1992 |
| EP | 0 339 026 | B1 | 6/1993 |
| EP | 0 571 804 | A2 | 12/1993 |
| EP | 0 278 590 | B2 | 3/1994 |
| EP | 10315453 | | 1/1998 |
| EP | 1 165 319 | B1 | 2/2003 |
| JP | 03-121853 | | 5/1991 |
| JP | 3-121853 | | 5/1991 |
| JP | H3-140634 | | 5/1991 |
| JP | 04-341856 | | 11/1992 |
| JP | 04-366645 | | 12/1992 |
| JP | 06-182990 | | 7/1994 |
| JP | 06-219009 | | 8/1994 |
| JP | 10-315453 | | 12/1998 |
| WO | WO 96/32281 | | 10/1996 |
| WO | WO 98/19864 | | 5/1998 |

OTHER PUBLICATIONS

"Notice of Opposition to a European Patent," Patent Opposed 1 165 319, EPO, Munich, Nov. 18, 2003.

Patent Abstracts of Japan, Publication No. 04-341856, Publication Date: Nov. 27, 1992.

Response to Grounds of Opposition to EP 1165319 in the name of Spectra, Inc., Apr. 27, 2004.

Written Opinion on Opposition, European Patent Office, Serial No. EP 0 918 326.0, Nov. 8, 2004.

* cited by examiner

SPREAD RATE OF ONE SIDE OF A LINE FOR DIFFERENT SPLAT SIZES
FREQUENCY = 12.0 kHz VISCOSITY = 15.0 cp
SURFACE TENSION = 29.0 dynes/cm. DROP VOLUME = 15.0 pl

130

SWATH 0 (A-SWATH)

| PIXEL | MODULE # | X LOCATION | Y LOCATION | |
|---|---|---|---|---|
| 1 | 7 | 0.0000 | 0.0000 | |
| 2 | 2 | 0.0017 | 1.4000 | |
| 3 | 9 | 0.0033 | -0.4000 | |
| 4 | 4 | 0.0050 | 0.8000 | |
| 5 | 11 | 0.0067 | -1.0000 | |
| 6 | 6 | 0.0083 | 0.4000 | |
| 7 | 12 | 0.0100 | -1.2000 | |
| 8 | 5 | 0.0117 | 0.6000 | |
| 9 | 10 | 0.0133 | -0.8000 | |
| 10 | 3 | 0.0150 | 1.2000 | |
| 11 | 8 | 0.0167 | -0.2000 | |
| 12 | 2 | 0.0183 | 1.6000 | |
| 13 | 7 | 0.0200 | 0.0000 | REPEAT OF PATTERN |
| 14 | 2 | 0.0217 | 1.4000 | REPEAT OF PATTERN |
| ⋮ | ⋮ | ⋮ | ⋮ | |
| 1535 | 8 | 2.5567 | -0.2000 | END OF SWATH 0 |
| 1536 | 1 | 2.5583 | 1.8000 | END OF SWATH 0 |
| 1537 | 12 | 2.5600 | 2.5890 | BEGINNING OF SWATH 1 |
| 1538 | 5 | 2.5617 | 4.3890 | BEGINNING OF SWATH 1 |
| ⋮ | ⋮ | ⋮ | ⋮ | |
| 3071 | 11 | 5.1167 | 2.7890 | END OF SWATH 1 |
| 3072 | 6 | 5.1183 | 4.1890 | END OF SWATH 1 |
| 3073 | 7 | 5.1200 | 0.0000 | BEGINNING OF SWATH 2 |
| 3074 | 2 | 5.1217 | 1.4000 | BEGINNING OF SWATH 2 |
| ⋮ | ⋮ | ⋮ | ⋮ | |
| 4607 | 8 | 7.6767 | -0.2000 | END OF SWATH 2 |
| 4608 | 1 | 7.6783 | 1.6000 | END OF SWATH 2 |

FIG. 12

SINGLE-PASS INKJET PRINTING

RELATED APPLICATIONS

This application is a continuation (and claims the benefit of priority under 35 USC 120) of U.S. application Ser. No. 11/114,935, filed Apr. 26, 2005 now U.S. Pat. No. 7,156,502 which is a continuation of U.S. application Ser. No. 10/039,074, filed Dec. 31, 2001, which issued as U.S. Pat. No. 6,926,384 on Aug. 9, 2005, which is a continuation of U.S. application Ser. No. 09/277,839, filed Mar. 26, 1999, which issued as U.S. Pat. No. 6,575,558 on Jun. 10, 2003. The disclosures of the prior applications are considered part of (and are incorporated by reference in) the disclosure of this application.

BACKGROUND

This invention relates to single-pass inkjet printing.

In typical inkjet printing, a print head delivers ink in drops from orifices to pixel positions in a grid of rows and columns of closely spaced pixel positions.

Often the orifices are arranged in rows and columns. Because the rows and columns in the head do not typically span the full number of rows or the full number of columns in the pixel position grid, the head must be scanned across the substrate (e.g., paper) on which the image is to be printed.

To print a full page, the print head is scanned across the paper in a head scanning direction, the paper is moved lengthwise to reposition it, and the head is scanned again at a new position. The line of pixel positions along which an orifice prints during a scan is called a print line.

In a simple scheme suitable for low resolution printing, during a single scan of the print head adjacent orifices of the head print along a stripe of print lines that represent adjacent rows of the pixel grid. After the stripe of lines is printed, the paper is advanced beyond the stripe and the next stripe of lines is printed in the next scan.

High-resolution printing provides hundreds of rows and columns per inch in the pixel grid. Print heads typically cannot be fabricated with a single line of orifices spaced tightly enough to match the needed printing resolution.

To achieve high resolution scanned printing, orifices in different rows of the print head can be offset or inclined, print head scans can be overlapped, and orifices can be selectively activated during successive print head scans.

In the systems described so far, the head moves relative to the paper in two dimensions (scanning motion along the width of the paper and paper motion along its length between scans).

Inkjet heads can be made as wide as an area to be printed to allow so-called single-pass scanning. In single-pass scanning, the head is held in a fixed position while the paper is moved along its length in an intended printing direction. All print lines along the length of the paper can be printed in one pass.

Single-pass heads may be assembled from linear arrays of orifices. Each of the linear arrays is shorter than the full width of the area to be printed and the arrays are offset to span the full printing width. When the orifice density in each array is smaller than the needed print resolution, successive arrays may be staggered by small amounts in the direction of their lengths to increase the effective orifice density along the width of the paper. By making the print head wide enough to span the entire breadth of the substrate, the need for multiple back and forth passes can be eliminated. The substrate may simply be moved along its length past the print head in a single pass. Single-pass printing is faster and mechanically simpler than multiple-pass printing.

Theoretically, a single integral print head could have a single row of orifices as long as the substrate is wide. Practically, however, that is not possible for at least two reasons.

One reason is that for higher resolution printing (e.g., 600 dpi), the spacing of the orifices would be so small as to be mechanically unfeasible to fabricate in a single row, at least with current technology. The second reason is that the manufacturing yield of orifice plates goes down rapidly with increases in the number of orifices in the plate. This occurs because there is a not insignificant chance that any given orifice will be defective in manufacture or will become defective in use. For a print head that must span a substrate width of, say, 10 inches, at a resolution of 600 dots per inch, the yield would be intolerably low if all of the orifices had to be in a single orifice plate.

SUMMARY

In general, in one aspect, the invention features a single-pass ink jet printing head having an array of ink jet outlets sufficient to cover a target width of a print substrate at a predetermined resolution. There are multiple orifice plates each having orifices. Each of the orifice plates serves some but not all of the area to be printed. The orifices in the array are arranged in a pattern such that adjacent parallel lines on the print medium are served by orifices that have positions in the array along the direction of the print lines that are separated by a distance that is at least an order of magnitude greater than the distance between adjacent orifices in a direction perpendicular to the print line direction.

Implementations of the invention may include one or more of the following features. Each of the orifice plates may be associated with a print head module that prints a swath along the substrate, the swath being narrower than the target width of the substrate. The number of orifices in each of the orifice plates may be within a range of 250 to 4000, preferably between 1000 and 2000, most preferably about 1500. There may be no more than five swath arrays, e.g., three, to cover the entire target width.

Other advantages and features will become apparent from the following description and from the claims.

DESCRIPTION

FIGS. 1, 2, and 3 illustrate web weave.

FIG. 12 is a table of orifice locations.

The quality of printing generated by a single-pass inkjet print head can be improved by the choice of pattern of orifices that are used to print adjacent print lines. An appropriate choice of pattern provides a good tradeoff between the effect of web weave and the possibility of print gaps caused by poor line merging.

Figure 1:
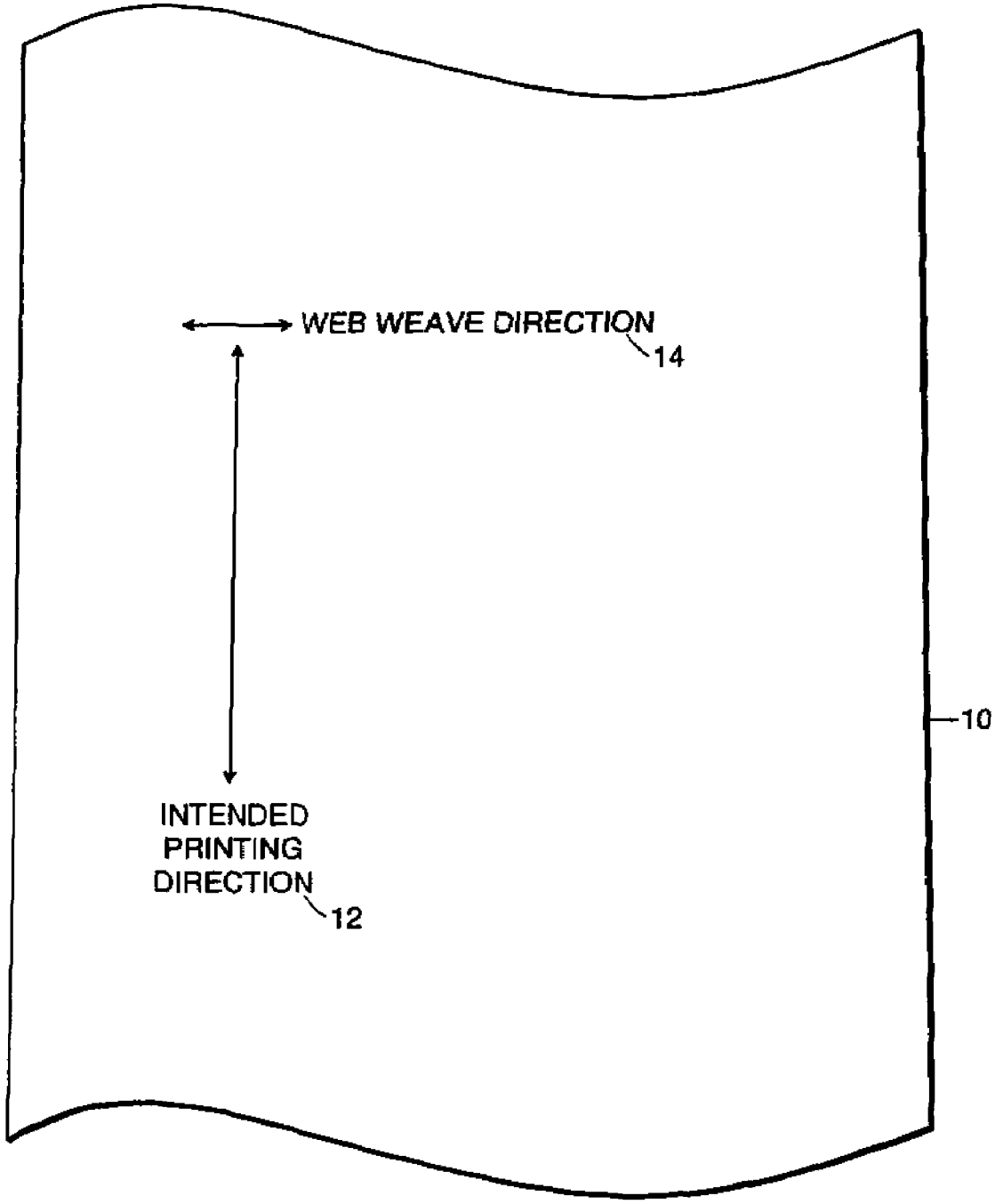
Figure 2:
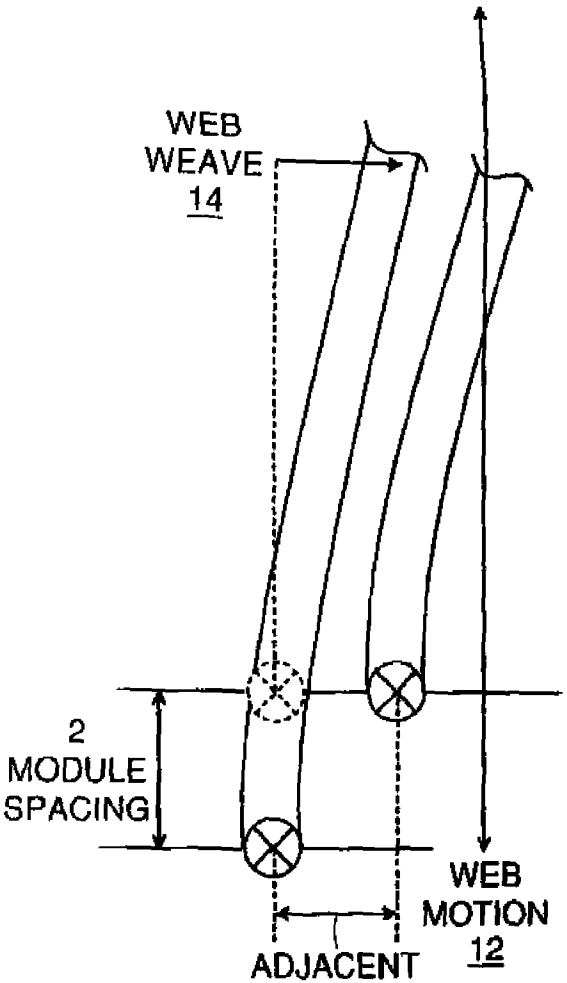

As seen in FIGS. 1 and 2, paper 10 that is moved along its length during printing is subject to so-called web weave, which is the tendency of the web (e.g., paper) not to track perfectly along the intended direction 12, but instead to move back and forth in a direction 14 perpendicular to the intended printing direction. Web weave can degrade the quality of inkjet printing.

Figure 3:
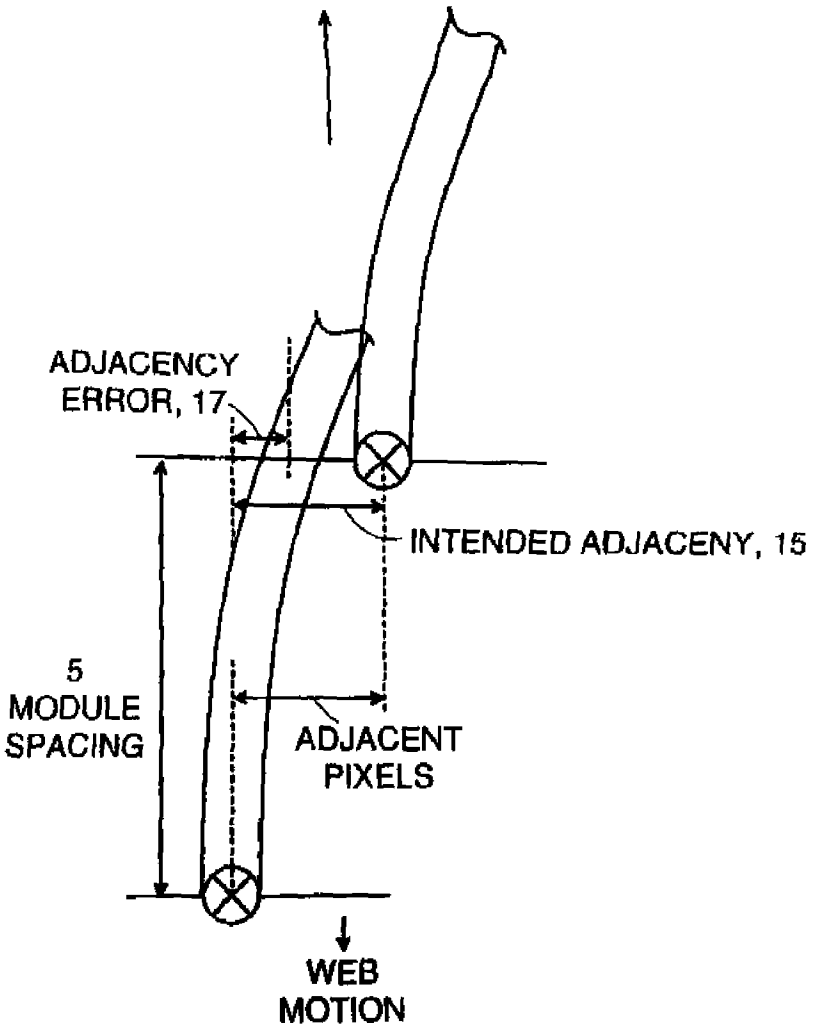

Web weave can be measured in mils per inch. A weave of 0.2 mils per inch means that for each inch of web travel in the intended direction, the web may travel as much as 0.2 mils to one side or the other. As seen in FIGS. 2 and 3, when the inkjet orifices are not arranged in a single straight line along the paper width, but instead are spaced apart along the intended direction of web motion, the web weave produces an adjacency error 17 in drop placement compared with an intended adjacency distance 15. For example, with a web weave of 0.2 mils per inch and a spacing between neighboring orifices of 1.5 inches in the web motion direction, an adjacency error of 0.3 mils in the direction perpendicular to the main direction of motion may be introduced in the distance between resulting adjacent print lines.

If avoiding the effects of web weave were the only concern, a good pattern would minimize the spacing along the print line direction between orifices addressing adjacent print lines. In such an arrangement, the adjacent lines would be printed at nearly the same times and web weave would have almost no effect. Yet, for a head with twelve modules spaced along the print line direction (see FIG. 10), it would not be good to have a repeated pattern in which the orifices that print adjacent print lines are only one module apart (e.g., in modules 1, 2, . . . , 11, 12, 1, 2, . . . ). In that case, the final orifice in the pattern would be in the twelfth module, eleven modules away from the first orifice in the second repetition of the pattern, which would be in the first module again.

As seen in FIG. 2, for purposes of avoiding the effects of web weave, a pattern with a maximum spacing of two modules would work well. The modules printing successive pixels in the direction perpendicular to the intended motion of the web could be modules 1, 3, 5, 7, 9, 11, 12, 10, 8, 6, 4, 2 and then back to 1. However, as explained below, when the effects of poor line merging are also considered, this pattern is not ideal. On the other hand, as seen in FIG. 3, if adjacent lines are printed by modules separated by, say, five modules along the intended direction of web motion, the effects of web weave are more significant.

Figure 4:
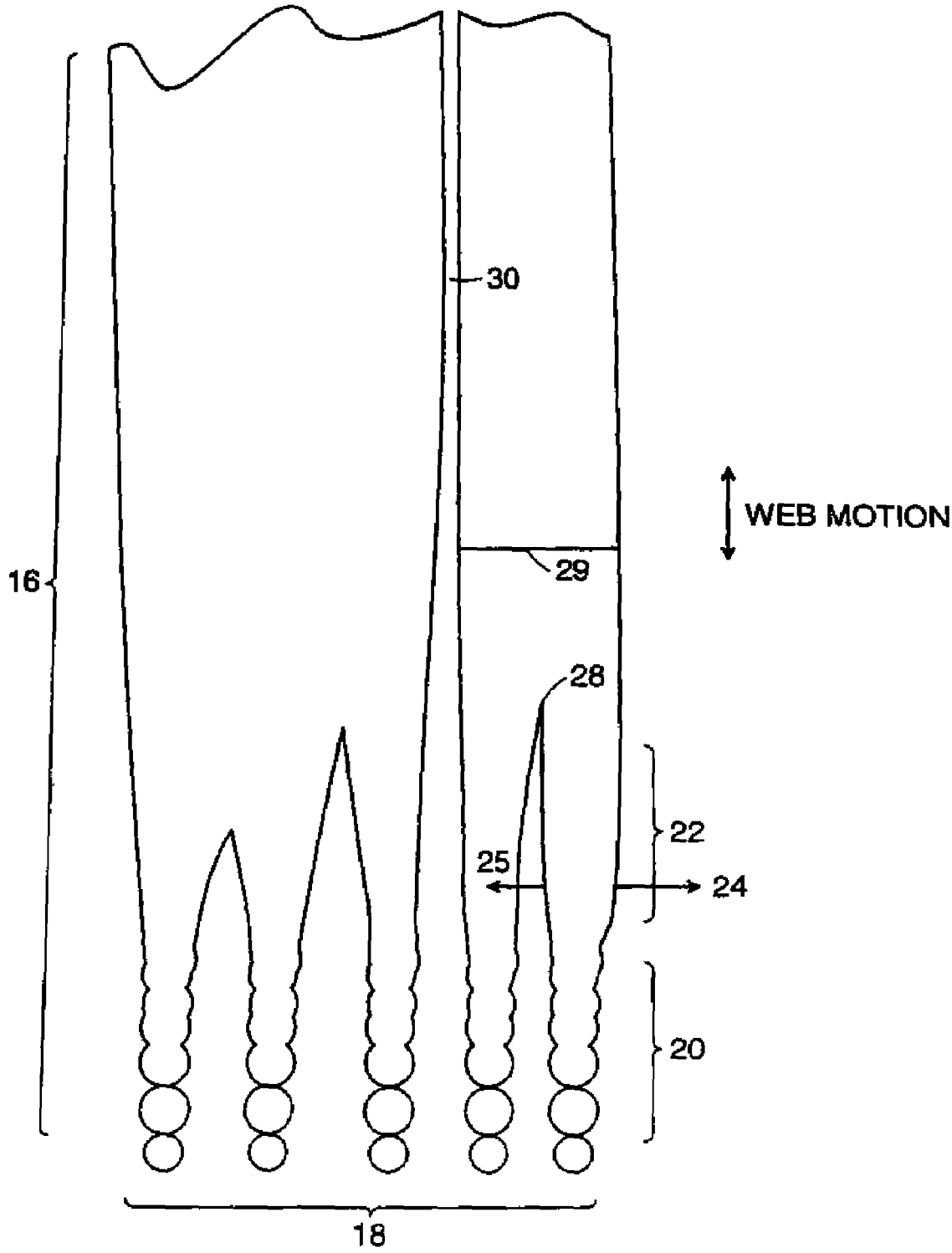
FIGS. 4 and 5 illustrate line merging.

As seen in FIG. 4, another cause of poor inkjet printing quality may occur when all pixels in a given area 16 are to be filled by printing several continuous, adjacent lines 18. In printing each of the continuous lines, a series of drops 20 rapidly merge to form a line 22 which spreads 24, 26 laterally (in the two opposite directions perpendicular to the print line direction) across the paper surface. Ideally, adjacent lines that are spreading eventually reach each other and merge 28 to fill a two-dimensional region (stripe) that extends both along and perpendicularly to the line direction.

For non-absorbent web materials, the spreading of a line edge is said to be contact angle limited. (The contact angle is the angle between the web surface and the ink surface at the edge where the ink meets the web surface, viewed in cross-section.) As the line spreads, the contact angle gets smaller. When the contact angle reaches a lower limit (e.g., 10 degrees) line spreading stops.

As adjacent lines merge, the contact angle of the line edges declines. The rate of lateral spread of the merged stripe declines because the reduced contact angle produces higher viscous retarding forces and lower surface tension driving forces. The reduction in lateral spreading can produce white gaps 30 between adjacent lines that have respectively merged with their neighbors on the other side from the gap.

The lateral spread rate of the edges of one or more merged print lines varies inversely with the third power of the number of lines merged. By this rule, when two lines (or stripes) merge into a single stripe, the rate at which the edges of the merged stripe spread laterally is eight times slower than the rate at which the constituent lines or stripes were spreading. However, when the spreading is contact angle limited, the effect of merging can be to stop the spreading. Consequently, as printing progresses various pairs of adjacent lines and/or stripes merge or fail to merge depending on the distances between their neighboring edges and the rates of spreading implied by the numbers of their constituent original lines. For some pairs of adjacent lines and/or stripes, the rate of spreading stops or becomes so small as to preclude the gap ever being filled. The result is a permanent undesired un-printed gap 30 that remains unfilled even after the ink solidifies.

The orifice printing pattern that may best reduce the effects of poor line merging tends to increase the negative effects of web weave.

Figure 5:
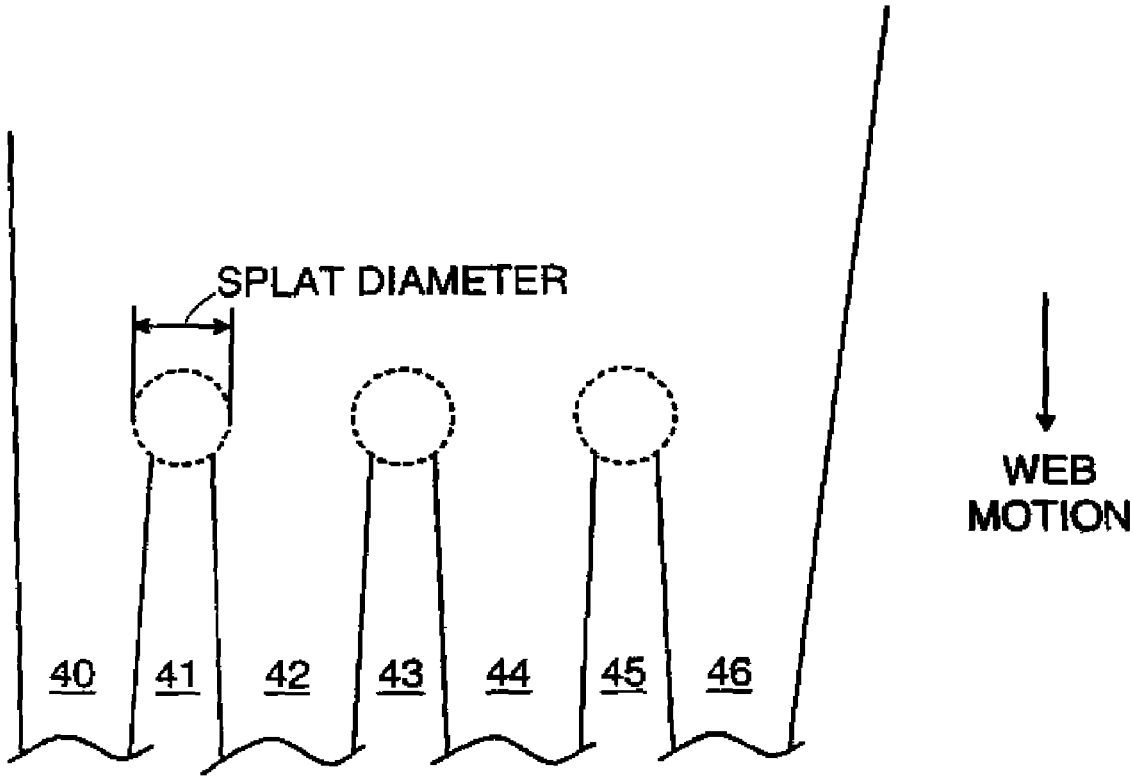

As seen in FIG. 5, ideally, to reduce the effects of poor line merging, every other line 40, 42, 44, 46 would be printed at the same time and be allowed to spread without merging, leaving a series of parallel gaps 41, 43, 45 to be filled. After allowing as much time as possible to pass, so that the remaining gaps become as narrow as possible, the remaining lines would be filled in by bridging the gaps using the intervening drop streams, as shown, taking account of the splat diameter that is achieved as a result of the splat of a drop as it hits the paper, so that no additional spread is required to achieve a solid printed region without gaps. By splat diameter, we mean the diameter of the ink spot that is generated in the fraction of a second after a jetted ink drop hits the substrate and until the inertia associated with the jetting of the drop has dissipated. During that period, the spreading of the drop is governed by the relative influences of inertia (which tends to spread the drop) and viscosity (which tends to work against spreading.) Allowing as much time as possible to pass before laying down the intervening drop streams would mean an orifice printing pattern in which adjacent lines are laid down by orifices that are spaced apart as far as possible along the print line direction, exactly the opposite of what would be best to reduce the effect of web weave.

Figure 6:
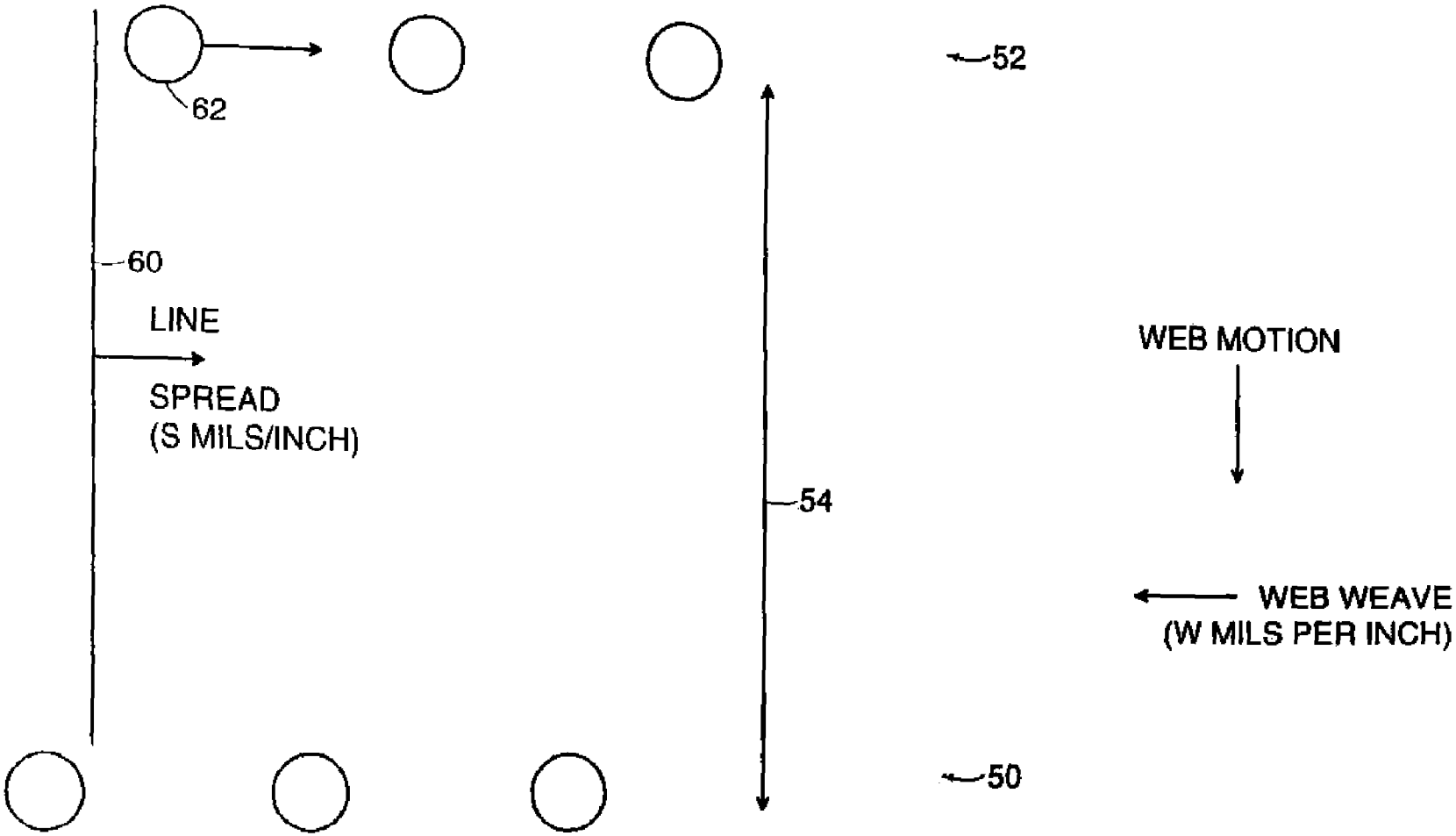
FIG. 6 illustrates the interplay of web weave and line merging.
Figure 7:
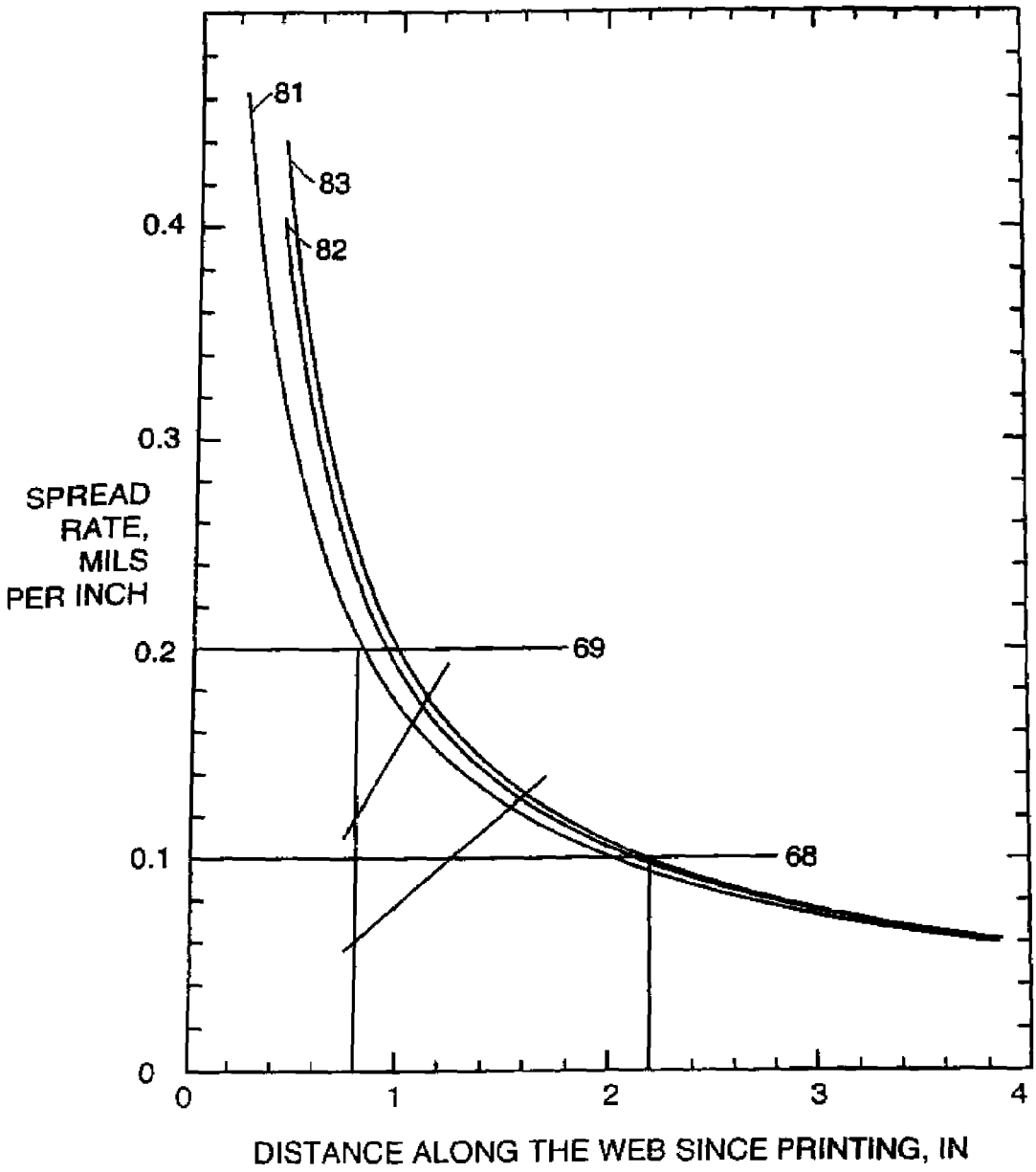
FIG. 7 is a graph of line spread as a function of distance.

A useful distance along the print line direction between orifices that print adjacent lines would trade off the web weave and line spreading factors in an effective way. As seen in FIG. 6, assume for the moment (we will relax this requirement later) that the orifices are arranged in two lines 50, 52 that contain adjacent orifices. We would like to find a good distance 54 between the lines. Assume also that web weave causes the web to move to the left at a constant rate (at least for the short distance under consideration) of W mils per inch of web motion in the line printing direction. Assume also that the line edge 60 spreads away from a center of a printed line at a rate that is expressed by a declining function S(d) mils per inch where d is the distance from the point where the drops are ejected onto the paper. FIG. 7 shows three similar curves 81, 82, 83 of calculated spread rate versus distance along the web since ejection for three different splat diameters.

In the example, the important consideration arises with respect to the printing of drop 62 (FIG. 6), which is effectively moving to the right in the figure (because of web weave) and the motion of the edge of line 60 to the right. At first, as the line is formed from the series of ejected drops, the line edge is moving more rapidly to the right than would be the position of drop 62 with distance along the web. Thus, the overlap of the splat and the spreading line increases. However, the rate of line spreading decreases while the rate of web weave, in a short distance, does not, so the amount of overlap reaches a peak and begins to decline. We seek a position for drop 62 that maximizes the overlap. The maximum overlap occurs when the rate of spreading equals the rate of web weave.

In FIG. 7 horizontal lines can be drawn to represent web weave rates. For web weave rates between 0.1 and 0.2 mils per inch, represented by lines 68, 69, the intersections with curves 81, 82, 83 occur in the range of 0.8 to 2.2 inches separation.

Figure 8:
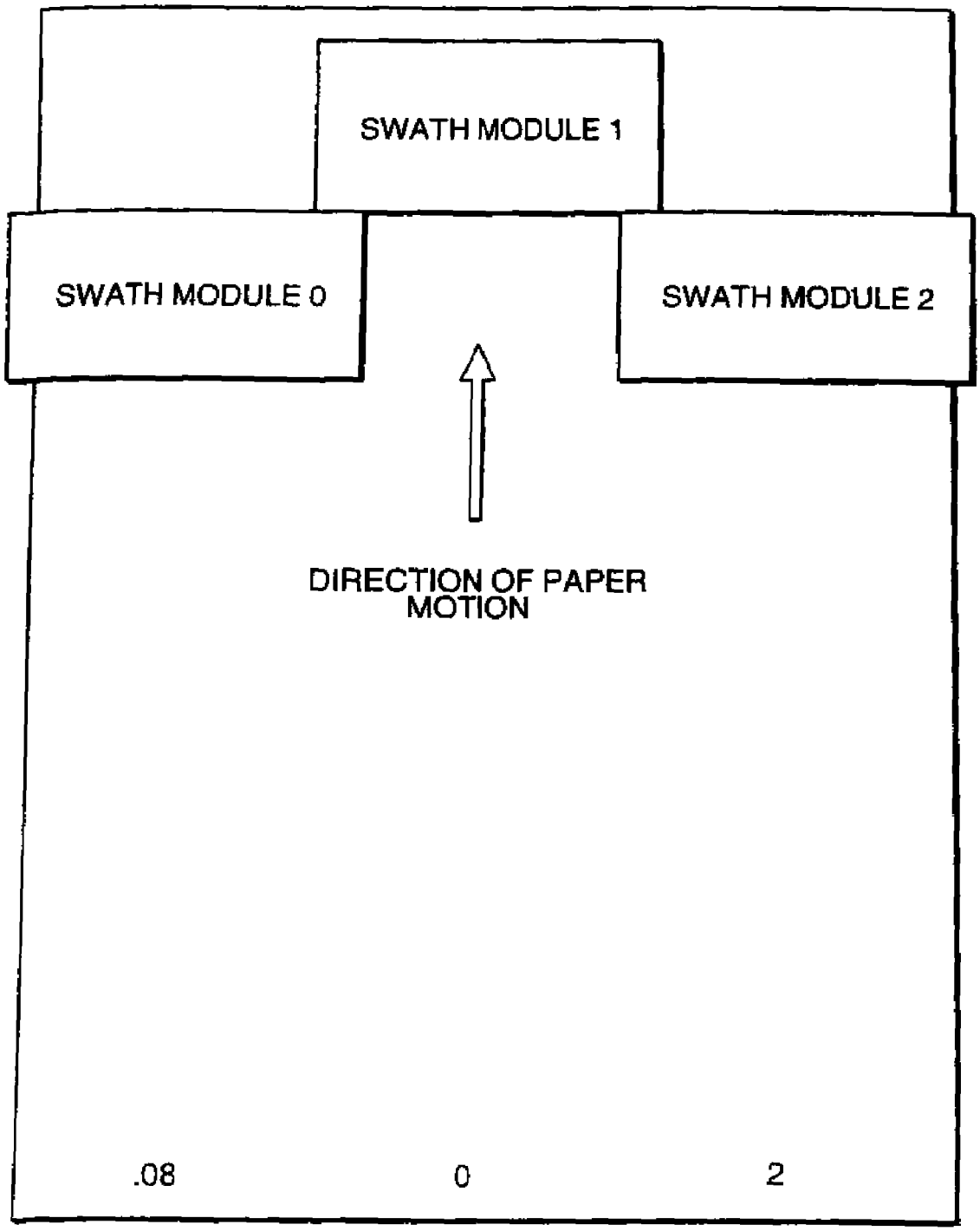
FIG. 8 is a diagram of a page moving under a single-pass print head.

As seen in FIG. 8, a print head that can be operated using an orifice printing pattern that falls within the range shown in FIG. 7, includes three swath modules 0, 1, and 2, shown schematically. The three swath modules respectively print three adjacent swaths 108, 110, 112 along the length of the paper as the paper is moved in the direction indicated by the arrow.

Figure 9:
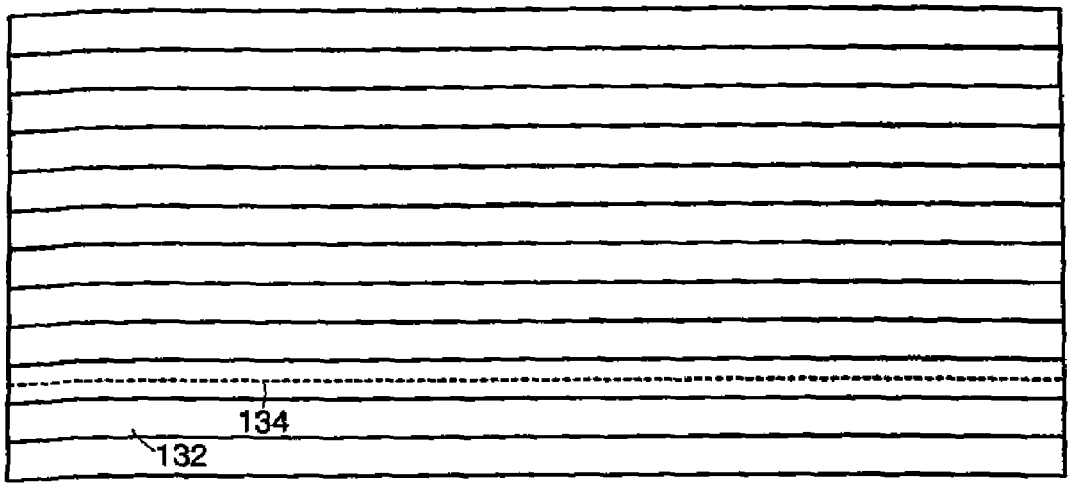
FIG. 9 is a schematic diagram of a swath module.

As seen in FIG. 9, each swath module 130 has twelve linear array modules arranged in parallel. Each array module has a row of 128 orifices 134 that have a spacing interval of 12/600 inches for printing at a resolution of 600 pixels per inch across the width of the paper. (The number of orifices and their shapes are indicated only schematically in the figure.)

Figure 10:
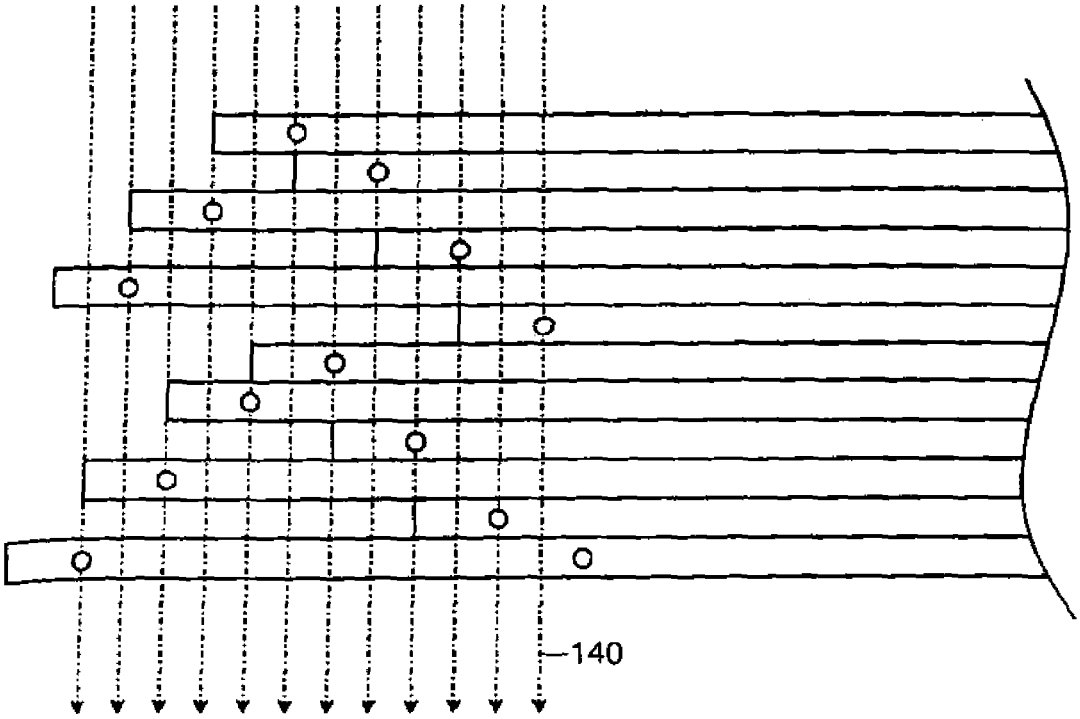
FIG. 10 is a schematic diagram of orifice staggering.

As seen in FIG. 10, to assure that every pixel position across the width of the paper is covered by an orifice that prints one of the needed print lines 140 along the length of the paper, the twelve identical array modules are staggered (the staggering is not seen in FIG. 9) in the direction of the lengths of the arrays. As seen, the first orifice (marked by a large black dot) in each of the modules thus uniquely occupies a position along the width of the paper that corresponds to one of the needed print lines.

In the bottom array module shown in the figure, the position of the second orifice is shown by a dot, but the subsequent orifice locations in that array and in the other arrays are not shown. Also, although FIG. 10 shows the pattern of staggering for one of the three swath modules, the other two swath modules have another, different pattern of staggering, described below.

Figure 11:
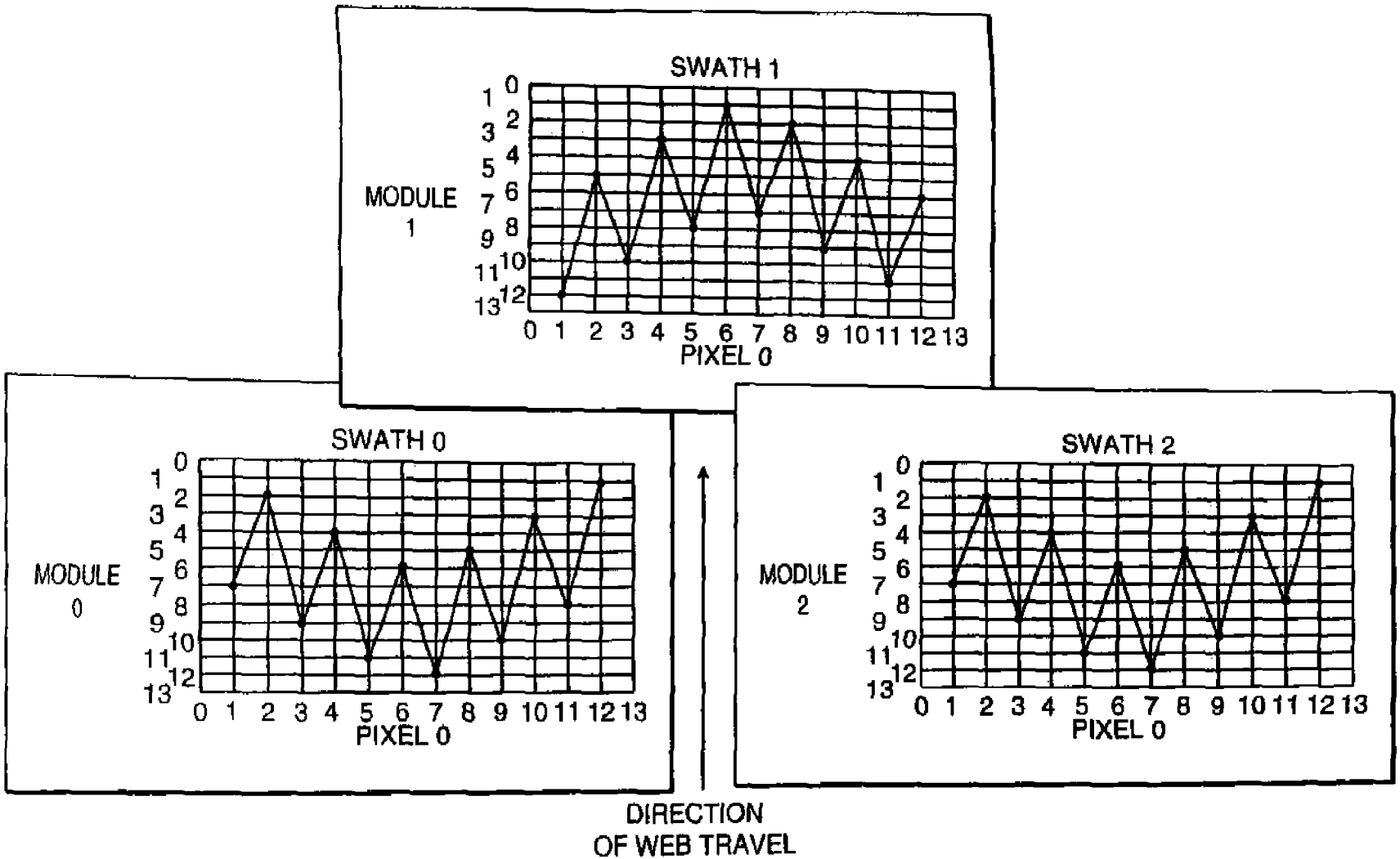
FIG. 11 is a graphical diagram of orifice staggering.

In FIG. 11, the patterns of staggering for all three swath modules are shown graphically. The patterns have a sawtooth profile. Each orifice is either upstream or downstream along the printing direction of both of the neighboring orifices with only one exception, at the transition between swath module 0 and swath module 1. The graph for each swath module contains dots to show which of the first twelve pixels that are covered by that swath module is served by the first orifice of each of the array modules. The graph for each swath module only shows the pattern of staggering but does not show all of the orifices of the module. The pattern repeats 127 times to the right of the pattern shown for each swath module. For that purpose the twelfth pixel in each series is considered the zeroth pixel in the next series. Similarly, the module array numbered 12 in swath module 1 effectively occupies the 0 position along the Y axis in the swath modules 0 and 2 (although the figure, for clarity, does not show it that way).

FIG. 12 is a table that gives X and Y locations in inches of the first orifice of each of the array modules that make up swath module 0, relative to the position of pixel 1. FIG. 12 demonstrates the staggering pattern of array modules. For swath module 0, the pixel positions of the first orifices are listed in the column labeled "pixel". The module number of the array module to which the first orifice that prints that pixel belongs is shown in the column labeled "module number". The X location of the pixel in inches is shown in the column labeled "X location". The Y location of the pixel is shown in the column marked "Y location." The swath 2 module is arranged identically to the swath 0 module and the swath 1 module is arranged identically to (is congruent to) the other two modules (with a 180 degrees rotation).

The gap in the Y direction between the final orifice (numbered 1536) of the swath 0 module and the first orifice (numbered 1537) of the swath 1 module, 0.989 inches, violates the rule that each orifice is either upstream or downstream along the printing direction of both of the neighboring orifices. On the other hand, the gap in the Y direction between the final orifice (numbered 3072) of the swath 1 module and first orifice (numbered 3073) of the swath 2 module is 4.19 inches, which is good for line merge but not good for web weave.

Thus, in the example of FIGS. 10 through 12, the distance along the web direction that corresponds to the X-axis of FIG. 7 is between 1.2 and 2.0 inches for every adjacent pair of printing line orifices (which is more than an order of magnitude and almost two orders of magnitude larger than the orifice spacing—1/50 inch—in a given array module) except for the pairs that span the transitions between swath modules. Although there is some difference in the web direction distances for different pairs of orifices, it is desirable to keep the ratio of the smallest distance to the largest distance close to one, to derive the greatest benefit from the principles described above. In the case of FIGS. 11 and 12, the ratio is 1.67 (excluding the two transitional pairs).

The range of distances along the web direction discussed above implies a range of delay times between when an ink drop hits the substrate and when the next adjacent ink drops hit the substrate, depending on the speed of web motion along the printing direction. For a web speed of 20 inches per second, the range of distances of 1.2 to 2.0 inches translate to a range of durations of 0.06 to 0.1 seconds.

Each swath module includes an orifice plate adjacent to the orifice faces of the array modules. The orifice plate has a staggered pattern of holes that conform to the pattern described above. One benefit of the patterns of the table of FIG. 7 is that the orifice plate of swath modules 0, 1, and 2 are identical except that the orifice plate for swath module 1 is rotated 180 degrees compared to the other two. Because only one kind of orifice plate needs to be designed and fabricated, production costs are reduced.

Figure 13:
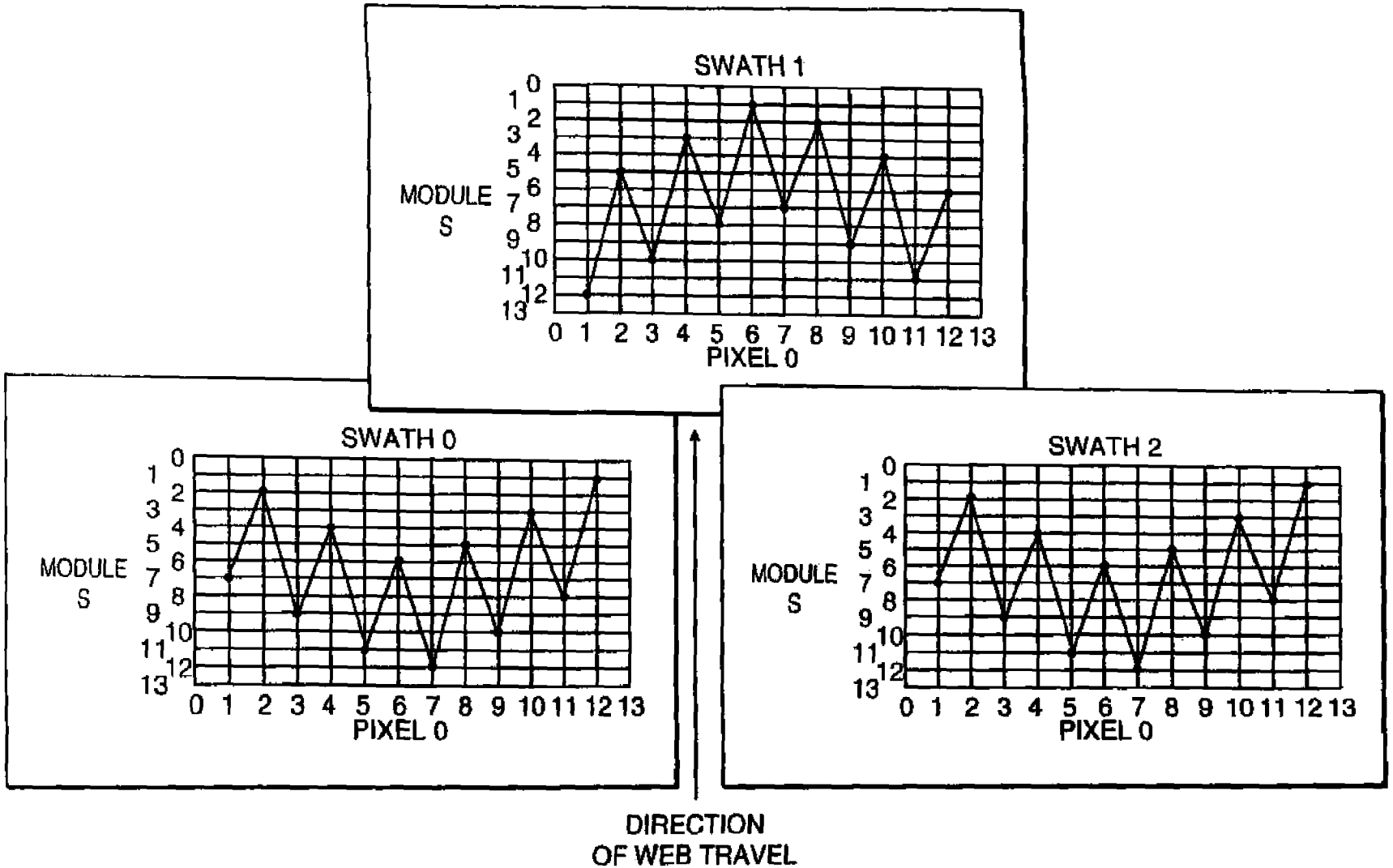
FIG. 13 is a graphical diagram of orifice staggering.

In FIG. 13, the swath 1 and 2 modules have been shifted to the left by two pixel positions relative to its position in FIG. 11. The twelfth pixel in module 0 (1536) and the first pixel in module 1 (1537) are disabled. The result is that the distance along the printing direction is increased to 4.589 inches, a distance that is worse with respect to web weave but better with respect to line merging.

Figure 14:
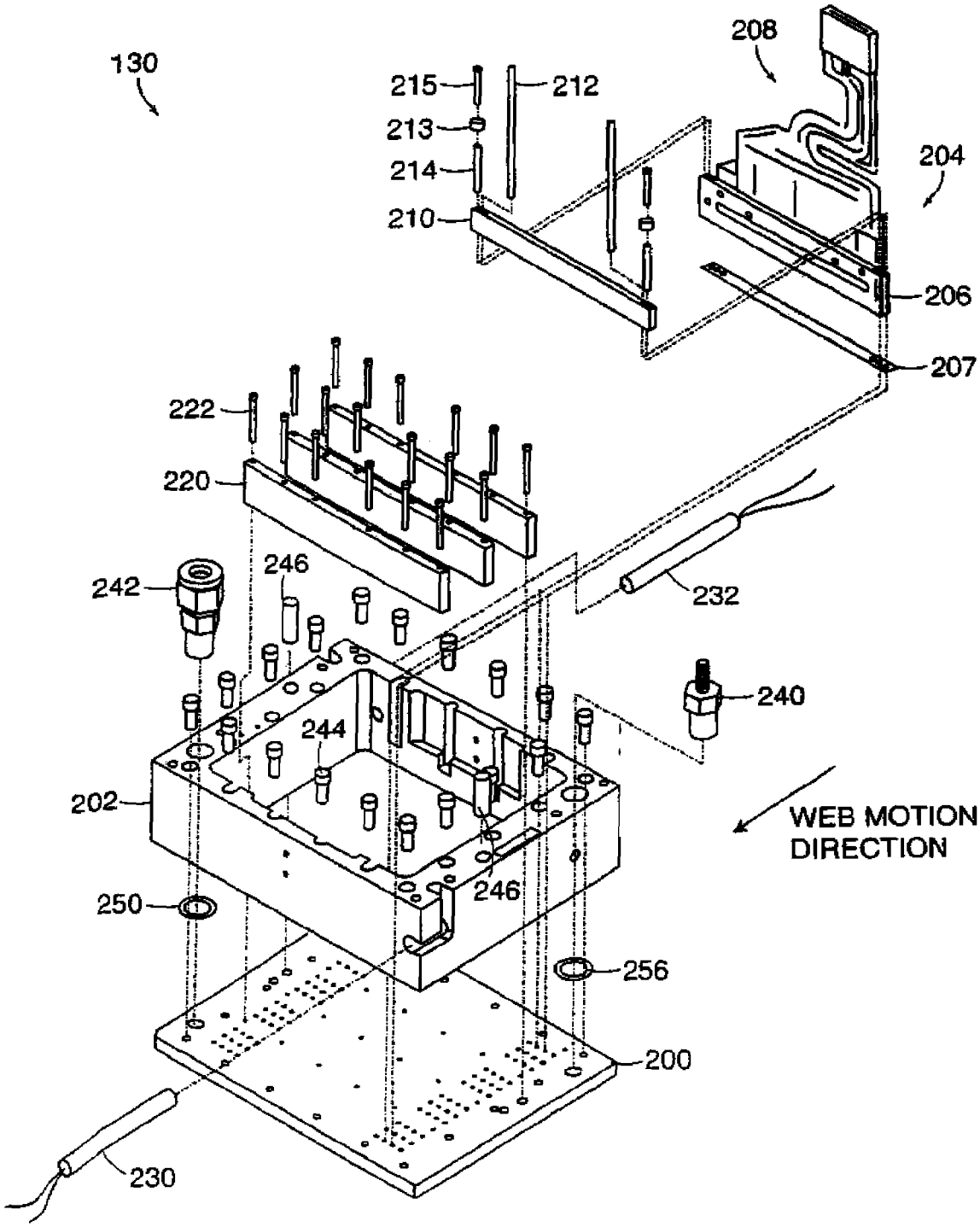
FIG. 14 is an exploded perspective assembly drawing of a swath module.

FIG. 14 shows the construction of each of the swath modules 130. The swath module has a manifold/orifice plate assembly 200 and a sub-frame 202 which together provide a housing for a series of twelve linear array module assemblies 204. Each module assembly includes a piezoelectric body assembly 206, a rock trap 207, a conductive lead assembly 208, a clamp bar 210, and mounting washers 213 and 214 and screws 215. The module assemblies are mounted in groups of three. The groups are separated by stiffeners 220 that are mounted using screws 222. Two electric heaters 230 and 232 are mounted in sub-frame 202. An ink inlet fitting 240 carries ink from an external reservoir, not shown, through the sub-frame 202 into channels in the manifold assembly 200. From there the ink is distributed through the twelve linear array module assemblies 204, back into the manifold 200, and out through the sub-frame 202 and exit fitting 242, returning eventually to the reservoir. Screws 244 are used to assemble the manifold to the sub-frame 200. Set screws 246 are used to hold the heaters 232. O-rings 250 provide seals to prevent ink leakage.

The number of swath arrays and the number of orifices in each swath array are selected to provide a good tradeoff between the scrap costs associated with discarding unusable orifice plates (which are more prevalent when fewer plates each having more orifices are used) and the costs of assembling and aligning multiple swath arrays in a head (which increase with the number of plates). The ideal tradeoff may change with the maturity of the manufacturing process.

The number of orifices in the orifice plate that serves the swath is preferably in the range of 250 to 4000, more preferably in the range of 1000-2000, and most preferably about 1500. In one example the head has three swath arrays each having twelve staggered linear arrays of orifices to provide 600 lines per inch across a 7.5 inch print area. The plate that serves each swath array then has 1536 orifices.

Other embodiments are within the scope of the following claims.

For example, the print head could be a single two-dimensional array of orifices or any combination of array modules or swath arrays with any number of orifices. The number of swath arrays could be one, two, three, or five, for example. Good separations along the print line direction between orifices that print adjacent print lines will depend on the number and spacing of the orifices, the sizes of the array modules, the relative importance of web weave, line merging, and cost of manufacture in a given application, and other factors.

The amount of web weave that can be tolerated is higher for lower resolution printing. Different inks could be used although ink viscosity and surface tension will affect the degree of line merging.

Other patterns of orifices could be used when the main concern is web weave or when the main concern is line merging.

What is claimed is:

1. In a single-pass ink-jet printer, a method of printing on a substrate that is in motion relative to a print head along print-line direction, the method comprising:

defining a delay interval on the basis of a spread rate of ink on a substrate;

causing the print head to eject a first ink drop through a first orifice onto a first location on the substrate;

causing the print head to eject a second ink drop through a second orifice onto a second location on the substrate, the second location being separated from the first location by a gap extending along a direction perpendicular to the print-line direction, the gap having an extent that decreases from an initial extent to a remaining extent as the first and second drops spread outward from the first and second locations;

following lapse of the delay interval, causing the print head to eject a third drop of ink through a third orifice onto a third location, the third location being within the remaining extent of the gap.

2. The method of claim 1, wherein defining a delay interval comprises defining an interval such that, by the end of the delay interval, the spread rate of the ink on the substrate has decreased to a selected fraction of an initial spread rate of the ink on the substrate.

3. The method of claim 1, further comprising selecting the second location to be displaced from the first location along a line perpendicular to the print line direction.

4. The method of claim 1, further comprising displacing the third orifice from the first orifice in a direction having a component along the print line direction.

5. The method of claim 4, further comprising selecting the displacement of the third orifice such that at the lapse of the delay interval, the third location is disposed for receiving an ink drop from the third orifice.

6. The method of claim 1, further comprising selecting a velocity for relative motion of the substrate and print head such that at the lapse of the delay interval, the third location is disposed for receiving an ink drop from the third orifice.

7. The method of claim 1, further comprising selecting a volume of the third drop to be sufficient to fill the remaining extent of the gap.

* * * * *